US010183513B2

(12) United States Patent
Jingushi

(10) Patent No.: US 10,183,513 B2
(45) Date of Patent: Jan. 22, 2019

(54) LIQUID EJECTING APPARATUS, AND CLEANING METHOD OF TRANSPORT BELT OF LIQUID EJECTING APPARATUS

(71) Applicant: SEIKO EPSON CORPORATION, Tokyo (JP)

(72) Inventor: Masaru Jingushi, Milan (IT)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/737,577

(22) PCT Filed: Jun. 20, 2016

(86) PCT No.: PCT/JP2016/002954

§ 371 (c)(1),
(2) Date: Dec. 18, 2017

(87) PCT Pub. No.: WO2016/208177

PCT Pub. Date: Dec. 29, 2016

(65) Prior Publication Data

US 2018/0185884 A1 Jul. 5, 2018

(30) Foreign Application Priority Data

Jun. 22, 2015 (JP) ..... 2015-124487

(51) Int. Cl.

| | |
|---|---|
| ***B41J 29/17*** | (2006.01) |
| ***B41J 11/00*** | (2006.01) |
| ***B08B 1/02*** | (2006.01) |
| ***B08B 3/02*** | (2006.01) |
| ***B41J 3/407*** | (2006.01) |
| ***B41J 13/08*** | (2006.01) |

(Continued)

(52) U.S. Cl.

CPC ..... *B41J 29/17* (2013.01); *B08B 1/02* (2013.01); *B08B 3/022* (2013.01); *B41J 3/4078* (2013.01); *B41J 11/007* (2013.01); *B41J 13/08* (2013.01); *B08B 1/04* (2013.01); *B41J 2/16538* (2013.01); *B41J 2002/16591* (2013.01)

(58) Field of Classification Search

CPC ..... B41J 29/17; B41J 11/007; B41J 3/4078; B41J 13/08; B41J 2/16538; B41J 2002/16591

See application file for complete search history.

(56) References Cited

U.S. PATENT DOCUMENTS 5,225,853 A * 7/1993 Kobayashi ..... B41J 29/17 346/104
2006/0104665 A1 5/2006 Koshida

FOREIGN PATENT DOCUMENTS

| | | |
|---|---|---|
| JP | 2008-030430 A | 2/2008 |
| JP | 2008-127192 A | 6/2008 |
| JP | 2011-098526 A | 5/2011 |

(Continued)

*Primary Examiner* — Geoffrey S Mruk

(57) ABSTRACT

A liquid ejecting apparatus in which a cleaning performance with respect to a transport belt is improved while suppressing a rise in cost of the apparatus is provided. A liquid ejecting apparatus is provided with a transport belt which transports a recording medium, and a cleaning unit which cleans the transport belt. The cleaning unit can move between a cleaning position and an evacuation position, and is positioned at the cleaning position using positioning pins which are provided in a frame unit as a housing, and a groove portion which is provided in the cleaning unit.

4 Claims, 4 Drawing Sheets

(51) Int. Cl.

| | |
|---|---|
| *B08B 1/04* | (2006.01) |
| *B41J 2/165* | (2006.01) |

(56) References Cited

FOREIGN PATENT DOCUMENTS

| | | |
|---|---|---|
| JP | 2012-116617 A | 6/2012 |
| JP | 2012-116619 A | 6/2012 |

* cited by examiner

[Fig. 1]
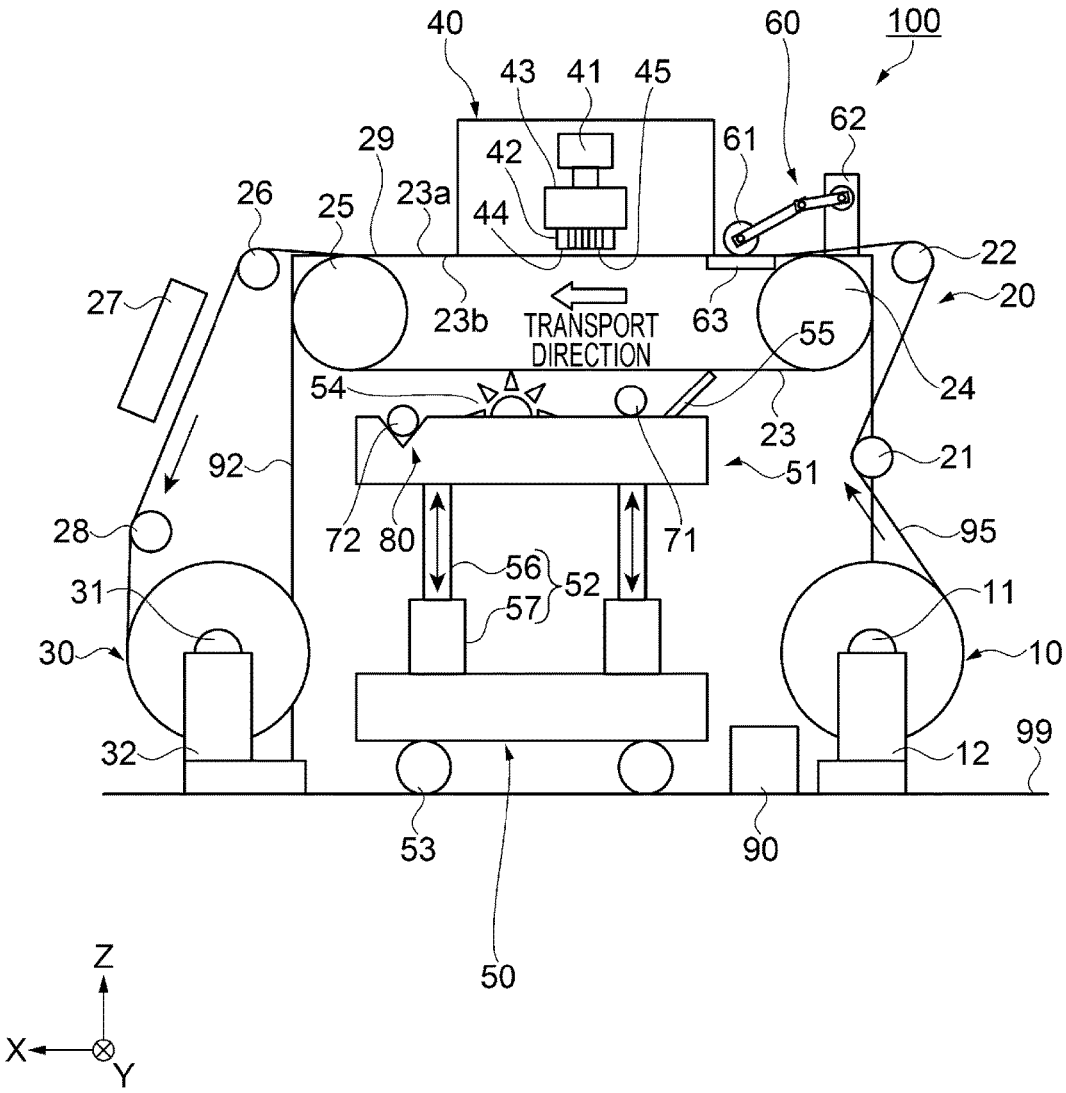

[Fig. 2]
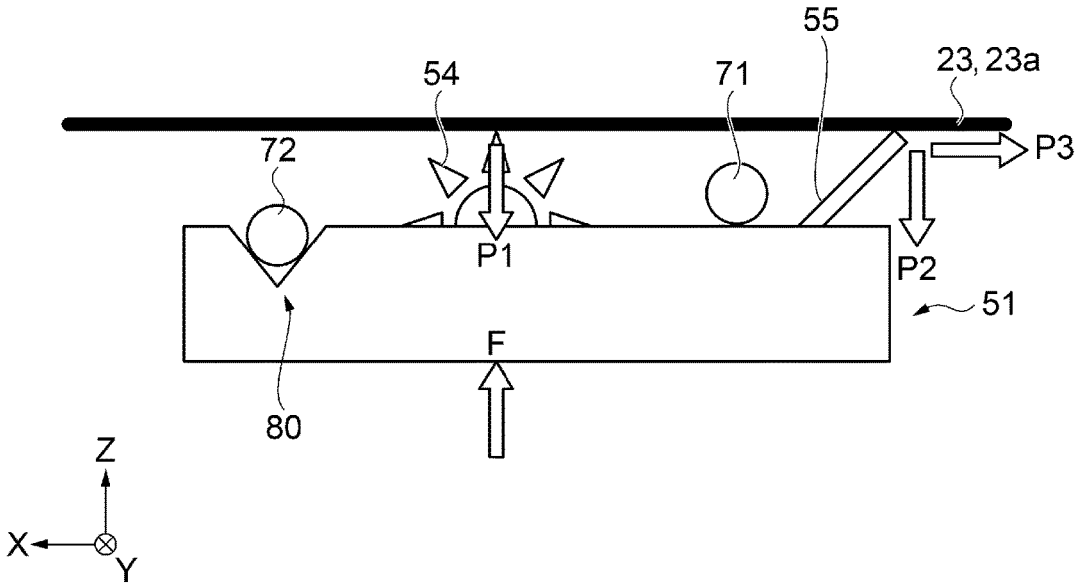
[Fig. 3]
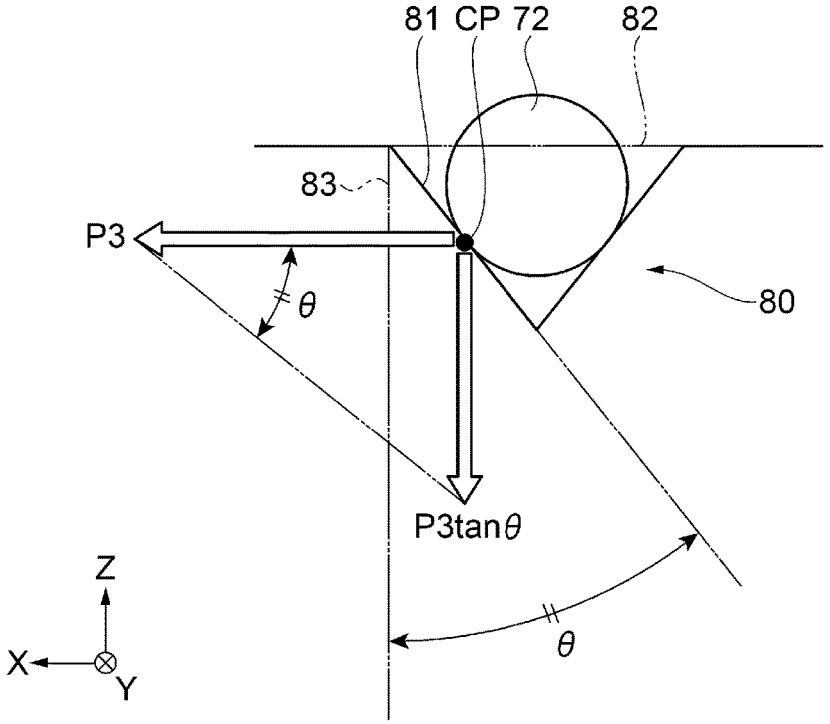

[Fig. 4]
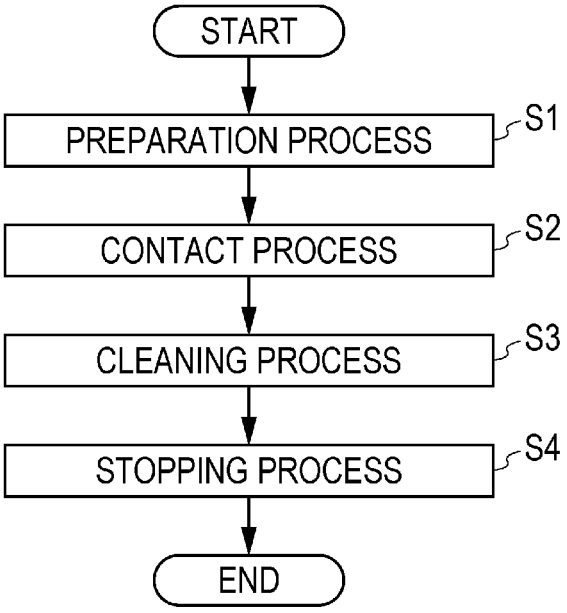

[Fig. 5]
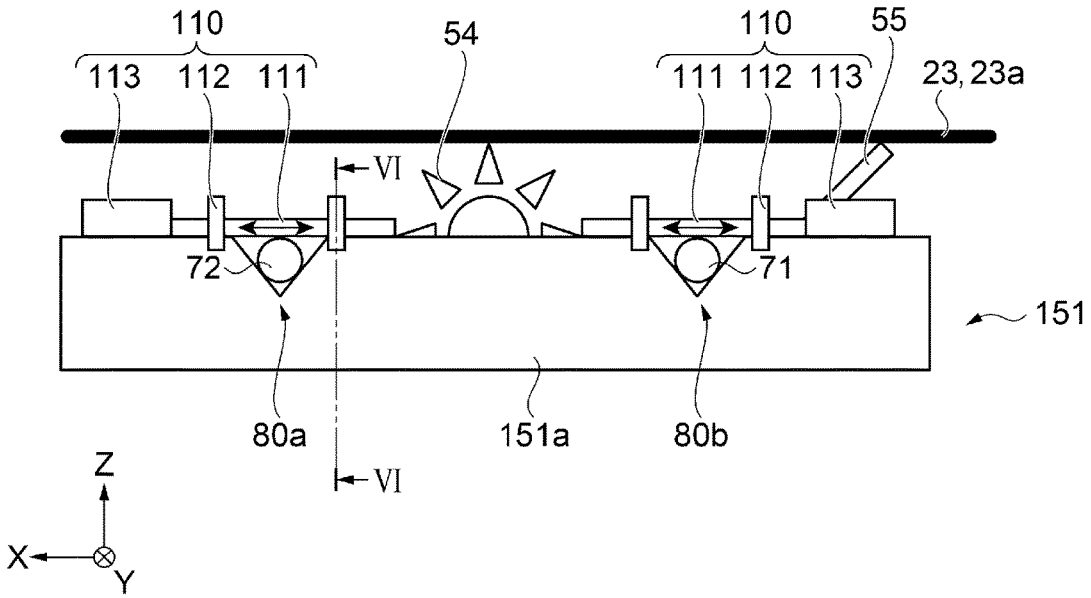
[Fig. 6]
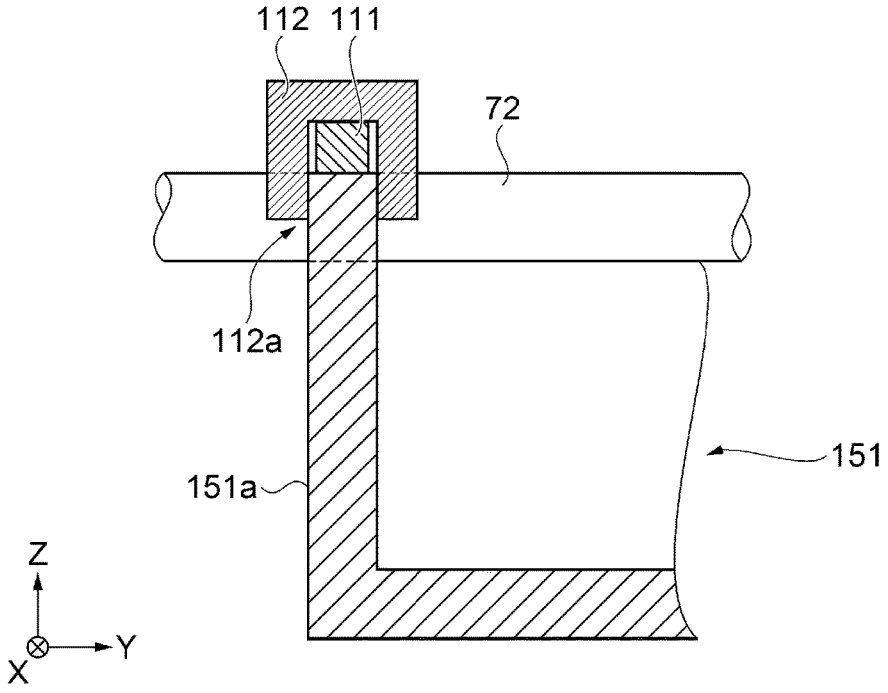

LIQUID EJECTING APPARATUS, AND CLEANING METHOD OF TRANSPORT BELT OF LIQUID EJECTING APPARATUS

CROSS REFERENCE TO RELATED APPLICATIONS

This application claims priority to Japanese Patent Application No. 2015-124487, filed Jun. 22, 2015. The entire disclosure of Japanese Patent Application No. 2015-124487 is hereby incorporated herein by reference.

TECHNICAL FIELD

The present invention relates to a liquid ejecting apparatus, and a cleaning method of a transport belt of the liquid ejecting apparatus.

BACKGROUND ART

In recent years, in textile printing with respect to cloth such as cotton, silk, wool, a synthetic fiber, or a mixed fabric, a liquid ejecting apparatus which ejects ink toward the surface of cloth, and performs printing of a pattern, or the like, on the cloth has been used. The liquid ejecting apparatus which is used in textile printing is provided with a transport mechanism which transports a recording medium by mounting the recording medium on an endless transport belt, which is adhesive, so as to treat elastic cloth as a printing medium. In such a liquid ejecting apparatus, it is necessary to perform cleaning of the transport belt since ink which comes out from a recording medium when performing printing at an end portion of the recording medium, ink which penetrates cloth, a fiber of the cloth, or the like, is attached to the surface of the transport belt. For this reason, for example, in JP-A-2012-116619, an image recording apparatus which is provided with a cleaning device (cleaning unit) which includes a cleaning liquid attaching unit (cleaning roller) which performs cleaning by attaching cleaning liquid onto the surface of an endless belt (transport belt), and a blade which removes the attached cleaning liquid is disclosed.

SUMMARY

In the liquid ejecting apparatus which is described in JP-A-2012-116619, in a case in which a transport speed of a transport belt is set to be high in order to improve productivity of the liquid ejecting apparatus, it is necessary to increase contact pressure which causes the blade and the cleaning roller to come into contact with the transport belt in order to improve a cleaning performance with respect to the transport belt. However, in a case in which the transport speed of the transport belt, and the contact pressures of the blade and the cleaning roller are increased, since a reaction force which acts in the vertical direction and the horizontal direction of the cleaning unit also increases, it is necessary to improve rigidity of the cleaning device including the cleaning unit in order to suppress a vibration which occurs due to the reaction force. There is a problem in that a cost of a liquid ejecting apparatus increases when rigidity of the cleaning device is improved.

The invention has been made so as to solve at least a part of the above described problems, and can be realized in the following aspects or application examples.

According to this application example, there is provided a liquid ejecting apparatus which includes a transport belt which transports a recording medium, and a cleaning unit which cleans the transport belt, in which the cleaning unit can move between a cleaning position and an evacuation position, and is positioned at the cleaning position using a positioning pin which is provided in a housing, and a groove portion which is provided in the cleaning unit.

According to the application example, in the liquid ejecting apparatus, the cleaning unit is positioned at the cleaning position using the groove portion which is provided in the cleaning unit, and the positioning pin which is provided in the housing. Since the cleaning unit is engaged by using the groove portion and the positioning pin, vibration in the vertical direction and the horizontal direction which occurs in the cleaning unit is suppressed. In the related art, it was necessary to strengthen rigidity of the apparatus in order to suppress the vibration which occurs in the cleaning unit in order to improve a cleaning performance with respect to the transport belt, and this caused a rise in cost of the liquid ejecting apparatus. However, since the vibration which occurs in the cleaning unit is suppressed by adopting the application example, it is possible to configure the liquid ejecting apparatus at a low cost. Accordingly, it is possible to provide a liquid ejecting apparatus in which a cleaning performance with respect to a transport belt is improved while suppressing a rise in cost of the apparatus.

In the liquid ejecting apparatus according to the application example, it is preferable that the cleaning unit includes a cleaning roller which cleans the transport belt, and a blade which removes water droplets of the transport belt, the groove portion forms a V-shaped isosceles triangle along the vertical direction, and when an angle formed of a vertical line which is orthogonal to a base and equal sides at a point at which the equal sides and the base cross each other is set to $\theta$, a force in the vertical direction which occurs in the cleaning unit when the cleaning roller comes into contact with the transport belt is set to $P\mathbf{1}$, a force in the vertical direction which occurs in the cleaning unit when the blade comes into contact with the transport belt is set to $P\mathbf{2}$, and a force in the horizontal direction which occurs in the cleaning unit when the blade comes into contact with the transport belt is set to $P\mathbf{3}$, it is preferable for the cleaning unit to come into contact with the positioning pin using a force F which forms a relationship of $F>P\mathbf{1}+P\mathbf{2}+P\mathbf{3}\tan\theta$.

According to the application example, since the cleaning unit of the liquid ejecting apparatus comes into contact with the positioning pin using the force F which forms the relationship of $F>P\mathbf{1}+P\mathbf{2}+P\mathbf{3}\tan\theta$, it is possible to prevent the positioning pin and the cleaning unit from being separated from each other. In this manner, it is possible to hold the cleaning unit at the cleaning position with high accuracy by stabilizing the cleaning unit, since a vibration in the vertical direction and the horizontal direction which occurs in the cleaning unit is suppressed.

It is preferable that the liquid ejecting apparatus according to the application example further includes a locking mechanism which fixes the cleaning unit to the cleaning position.

According to the application example, the liquid ejecting apparatus is provided with the locking mechanism which prevents the cleaning unit and the positioning pin from being separated from each other. It is possible to cut power for causing the cleaning unit to come into contact with the positioning pin, continuously, by operating the locking mechanism after causing the cleaning unit to come into contact with the positioning pin using the force F which forms the relationship of $F>P\mathbf{1}+P\mathbf{2}+P\mathbf{3}\tan\theta$. In this manner, it is possible to reduce power consumption of the liquid ejecting apparatus.

According to this application example, there is provided a cleaning method of a transport belt of a liquid ejecting apparatus which includes the transport belt which transports a recording medium, a cleaning unit which includes a cleaning roller which cleans the transport belt, and a blade which removes water droplets of the transport belt, and a positioning pin which is provided in a housing, and in which a groove portion which forms a V-shaped isosceles triangle is provided in the cleaning unit, the method including causing the cleaning unit to come into contact with the positioning pin using a force F which forms a relationship of $F>P1+P2+P3 \tan\theta$ when an angle formed of a vertical line which is orthogonal to a base and equal sides at a point at which the equal sides and the base of the groove portion cross each other is set to θ, a force in a vertical direction which occurs in the cleaning unit when the cleaning roller comes into contact with the transport belt is set to P1, a force in the vertical direction which occurs in the cleaning unit when the blade comes into contact with the transport belt is set to P2, and a force in a horizontal direction which occurs in the cleaning unit when the blade comes into contact with the transport belt is set to P3; and cleaning the transport belt by rotating the transport belt and the cleaning roller.

According to the application example, the cleaning unit of the liquid ejecting apparatus comes into contact with the positioning pin through a contact process in which the cleaning unit comes into contact with the positioning pin using the force F which forms the relationship of $F>P1+P2+P3 \tan\theta$, and is positioned at a cleaning position using the positioning pin and the groove portion. In this state, since the positioning pin and the cleaning unit do not separate from each other even in a case of performing a cleaning process in which the transport belt is cleaned by rotating the transport belt and the cleaning roller, a vibration in the vertical direction and the horizontal direction which occurs in the cleaning unit is suppressed. In the related art, it was necessary to strengthen rigidity of the apparatus in order to suppress a vibration which occurs along with an improvement of a cleaning performance with respect to the transport belt, and this caused a rise in cost of the apparatus. However, since the vibration is suppressed by adopting the Application Example, it is also possible to suppress the rise in cost of the apparatus. Accordingly, it is possible to provide a cleaning method of a transport belt of a liquid ejecting apparatus in which a cleaning performance with respect to the transport belt is improved, while suppressing a rise in cost of the apparatus.

BRIEF DESCRIPTION OF DRAWINGS

FIG. 1 is a schematic view which schematically illustrates the entire configuration of a liquid ejecting apparatus according to an embodiment.

FIG. 2 is an enlarged view of a cleaning unit.

FIG. 3 is an enlarged view of a groove portion.

FIG. 4 is a flowchart which describes a cleaning method of a transport belt.

FIG. 5 is a schematic view which illustrates a schematic configuration of a cleaning unit of a liquid ejecting apparatus according to a modification example.

FIG. 6 is a sectional view which is taken along line VI-VI in FIG. 5.

DESCRIPTION OF EMBODIMENTS

Hereinafter, an embodiment of the invention will be described with reference to drawings. In addition, in each figure below, a scale of each layer or each member is set to be different from a real scale in order to set each layer or each member to a recognizable size.

In addition, in FIGS. 1 to 3, 5 and 6, for ease of descriptions, an X axis, a Y axis, and a Z axis are illustrated as three axes which are orthogonal to each other, and a tip end side of an arrow which illustrates an axis direction is set to the "plus side", and a base end side is set to the "minus side". In addition, hereinafter, a direction parallel to the X axis is referred to as an "X axis direction", a direction parallel to the Y axis is referred to as a "Y axis direction", and a direction parallel to the Z axis is referred to as a "Z axis direction".

Embodiment

Schematic Configuration of Liquid Ejecting Apparatus

FIG. 1 is a schematic view which schematically illustrates the entire configuration of a liquid ejecting apparatus according to an embodiment. A liquid ejecting apparatus 100 performs textile printing of a recording medium 95 by forming an image on the recording medium 95. As the recording medium 95, for example, cloth such as cotton, wool, a synthetic fiber, or a mixed fabric is used. According to the embodiment, a configuration in which an image is formed on a belt-shaped recording medium 95 using a roll system will be described as an example; however, it is not limited to this. For example, it may be a system in which a sheet type, or the like, is used.

As illustrated in FIG. 1, the liquid ejecting apparatus 100 is provided with a recording medium supply unit 10, a recording medium transport unit 20, a recording medium collecting unit 30, a printing unit 40, a cleaning device 50, a medium adhering unit 60, and the like. In addition, a control unit 90 which controls each of the units is included. Each unit of the liquid ejecting apparatus 100 is attached to a frame unit 92 as a housing.

The recording medium supply unit 10 supplies the recording medium 95 for forming an image to the printing unit 40 side. The recording medium supply unit 10 includes a supply shaft 11 and a bearing 12. The supply shaft 11 is formed in a cylindrical shape or a columnar shape, and is rotatably provided in a circumferential direction. The belt-shaped recording medium 95 is wound around the supply shaft 11 in a roll shape. The supply shaft 11 is detachably attached to the bearing 12. In this manner, the recording medium 95 in a state of being wound around the supply shaft 11 in advance is set so as to be attached to the bearing 12 along with the supply shaft 11.

The bearing 12 rotatably supports both ends of the supply shaft 11 in the axial direction. The bearing 12 includes a rotation driving unit (not illustrated) which drives the supply shaft 11 in a rotating manner. The rotation driving unit rotates the supply shaft 11 in a direction in which the recording medium 95 is sent out. An operation of the rotation driving unit is controlled by the control unit 90, for example.

The recording medium transport unit 20 transports the recording medium 95 from the recording medium supply unit 10 to the recording medium collecting unit 30. The recording medium transport unit 20 is provided with a transport roller 21, a transport roller 22, a transport belt 23, a belt rotating roller 24, a belt driving roller 25, a transport roller 26, a drying unit 27, and a transport roller 28. The transport rollers 21 and 22 relay the recording medium 95 from the recording medium supply unit 10 to the transport belt 23 which will be described later.

The liquid ejecting apparatus 100 according to the embodiment is provided with the transport belt 23 which transports the recording medium 95. Specifically, the transport belt 23 is formed in an endless shape, and is hung on the belt rotating roller 24 and the belt driving roller 25. The transport belt 23 is held in a state of being applied with a predetermined tensile force so that a portion between the belt rotating roller 24 and the belt driving roller 25 is parallel to a floor face 99. An adhesive layer 29 which causes the recording medium 95 to be adhered thereto is provided on the surface (support face) 23*a* of the transport belt 2. The transport belt 23 supports (holds) the recording medium 95 on the surface 23*a* on which the adhesive layer 29 is provided. In this manner, cloth with elasticity, or the like, can be treated as the recording medium 95.

The belt rotating roller 24 and the belt driving roller 25 support an inner peripheral face 23*b* of the transport belt 23. In addition, it may be a configuration in which a support unit which supports the transport belt 23 is provided between the belt rotating roller 24 and the belt driving roller 25.

The transport belt 23 rotates along with a rotation of the belt driving roller 25 when the belt driving roller 25 is driven, and the belt rotating roller 24 rotates due to the rotation of the transport belt 23. The recording medium 95 which is supported by the transport belt 23 is transported in a predetermined transport direction (+X axis direction) due to the rotation of the transport belt 23. According to the embodiment, the +X axis direction from the belt rotating roller 24 to the belt driving roller 25 is set to the transport direction. In other words, the belt rotating roller 24 is arranged on the upstream side in the transport direction, and the belt driving roller 25 is arranged on the downstream side in the transport direction.

The transport rollers 26 and 28 relay the recording medium 95 from the transport belt 23 to the recording medium collecting unit 30. In addition, according to the embodiment, the drying unit 27 is arranged between the transport rollers 26 and 28. The drying unit 27 dries an image which is formed on the recording medium. In the drying unit 27, an IR heater is included, for example, and it is possible to dry an image formed on the recording medium in a short time by driving the IR heater.

The recording medium collecting unit 30 collects the recording medium 95 which is transported by the recording medium transport unit 20. The recording medium collecting unit 30 includes a winding shaft 31 and a bearing 32.

The winding shaft 31 is formed in a cylindrical shape or a columnar shape, and is rotatably provided in the circumferential direction. The belt-shaped recording medium 95 is wound around the winding shaft 31 in a roll shape. The winding shaft 31 is detachably attached to the bearing 32. In this manner, the recording medium 95 in a state of being wound around the winding shaft 31 is detached along with the winding shaft 31.

The bearing 32 rotatably supports both ends of the winding shaft 31 in the axis direction. The bearing 32 includes a rotation driving unit (not illustrated) which drives the winding shaft 31 in a rotating manner. The rotation driving unit rotates the winding shaft 31 in a direction in which the recording medium 95 is wound. An operation of the rotation driving unit is controlled by the control unit 90, for example.

The medium adhering unit 60 causes the recording medium 95 to adhere to the transport belt 23. The medium adhering unit 60 is arranged on the upstream side of the printing unit 40 in the transport direction of the recording medium 95. The medium adhering unit 60 includes a pressing roller 61, a pressing roller driving unit 62, and a roller support unit 63. The pressing roller 61 is formed in a cylindrical shape or a columnar shape, and is rotatably provided in a circumferential direction. The pressing roller 61 is arranged so that, for example, an axis direction intersects the transport direction so that the roller rotates in a direction which goes along the transport direction. The roller support unit 63 is provided on the inner peripheral face 23*b* side of the transport belt 23 which faces the pressing roller 61 by interposing the transport belt 23.

The pressing roller driving unit 62 moves the pressing roller 61 in the transport direction (+X axis direction) and a direction opposite to the transport direction (−X axis direction), while pressing the pressing roller 61 downward (−Z axis side) in the vertical direction. The recording medium 95 which is transported from the transport roller 22, and is superimposed on the transport belt 23 is pressed to the transport belt 23 between the pressing roller 61 and the roller support unit 63. In this manner, it is possible to reliably cause the recording medium 95 to adhere to the adhesive layer 29 which is provided on the surface 23*a* of the transport belt 23, and prevent floating of the recording medium 95 on the transport belt 23.

The printing unit 40 includes an ink jet-type ejecting head 42 which ejects ink toward the recording medium 95 as ink droplets, a head moving unit 41 which moves the ejecting head 42, and the like. The printing unit 40 is arranged on the upper part (+Z axis side) of an arranging position of the transport belt 23. The ejecting head 42 is provided with an ejecting face 44 on which a plurality of nozzle columns 45 are formed. For example, four nozzle columns 45 are formed on the ejecting face 44, and ink of a color which is different in each nozzle column 45 (for example, cyan: C, magenta: M, yellow: Y, and black: K) is ejected. The ejecting face 44 faces the recording medium 95 which is transported by the transport belt 23.

The head moving unit 41 moves the ejecting head 42 in a direction which intersects the transport direction of the recording medium 95 (width direction of recording medium 95 (Y axis direction)). The head moving unit 41 is provided with a carriage 43 on which the ejecting head 42 is mounted, and a moving mechanism (not illustrated) which moves the carriage 43 in the Y axis direction. The carriage 43 is supported by a guide rail (not illustrated) which is arranged along the Y axis direction, and is configured so as to reciprocate in the ±Y axis direction using the moving mechanism. As the moving mechanism, for example, it is possible to adopt a mechanism in which a ball screw and a ball nut are combined, a linear guiding mechanism, or the like.

In addition, a motor is provided in the moving mechanism, as a power source for moving the carriage 43 along the Y axis direction. When the motor is driven using a control of the control unit 90, the ejecting head 42 reciprocates along the ±Y axis direction along with the carriage 43. In addition, according to the embodiment, as the ejecting head 42, a serial head which is mounted on a movable carriage, and ejects ink while moving in the width direction (±Y axis direction) of the recording medium 95 has been exemplified; however, it may be a line head which extends in the width direction (Y axis direction) of the recording medium 95, and is arranged by being fixed.

The liquid ejecting apparatus 100 according to the embodiment is provided with positioning pins 71 and 72 which position a cleaning unit 51, which will be described later, at a predetermined position (cleaning position). The positioning pins 71 and 72 form columnar shapes which extend in the Y axis direction, and are attached to the frame unit 92 (housing) of the liquid ejecting apparatus 100.

The liquid ejecting apparatus 100 according to the embodiment is provided with a cleaning device 50 for cleaning the transport belt 23. Specifically, the cleaning device 50 is configured of the cleaning unit 51, a pressing unit 52, and a moving unit 53. The moving unit 53 can fix the cleaning device 50 to a predetermined position by integrally moving the device along the floor face 99. The cleaning device 50 is arranged between the belt rotating roller 24 and the belt driving roller 25 in the X axis direction.

The pressing unit 52 is a lifting unit which is configured of an air cylinder 56 and a ball bush 57, and causes the cleaning unit 51 which is provided thereon to move between the cleaning position and an evacuation position. The cleaning position is a position at which a cleaning roller 54 and a blade 55, which will be described later, and the transport belt 23 come into contact with each other. The evacuation position is a position at which the cleaning roller 54 and the blade 55, and the transport belt 23 are separated from each other. At the cleaning position, the cleaning unit 51 cleans the surface (support face) 23*a* of the transport belt 23 which is hung between the belt rotating roller 24 and the belt driving roller 25 in a state of being applied with a predetermined tensile force from below (−Z axis direction). In addition, FIG. 1 illustrates a case in which the cleaning unit 51 is lifted, and is arranged at the cleaning position.

The cleaning unit 51 functions as a tank which stores cleaning liquid which cleans ink or foreign substances attached to the surface 23*a* of the transport belt 23. As the cleaning liquid, for example, it is possible to use water, or a water soluble solvent (alcohol aqueous solution, or the like), and a surfactant or an antifoaming agent may be added as necessary. A groove portion 80 which is engaged with the positioning pin 72 is provided in the cleaning unit 51. The groove portion 80 is provided on both side walls on the +Y axis side and the −Y axis side of the cleaning unit 51, and forms an isosceles triangle of which upper ends on the side walls are open in a V shape along the vertical direction.

The cleaning unit 51 is positioned at the cleaning position using the positioning pins 71 and 72, and the groove portion 80. Specifically, a position of the cleaning unit 51 in the vertical direction (Z axis direction) is positioned when the positioning pin 71 and the upper end of the side wall of the cleaning unit 51 come into contact with each other, and the positioning pin 72 and the groove portion 80 come into contact with each other, due to extending of the pressing unit 52. A position of the cleaning unit 51 in the horizontal direction (X axis direction) is positioned when the positioning pin 72 is engaged with the groove portion 80.

The cleaning unit 51 includes the cleaning roller 54 which cleans the transport belt 23, and the blade 55 which removes water droplets of the transport belt 23. The cleaning roller 54 is a rotating roller with the same width as that of the transport belt 23 in the Y axis direction, or a width which is slightly larger than that. The cleaning roller 54 has a rotating shaft which extends in the Y axis direction, and brushes are formed in a roller shape at the periphery of the rotating shaft. The cleaning roller 54 is provided at a position at which a part of brushes is immersed in the cleaning liquid.

The cleaning unit 51 is provided with a driving motor (not illustrated) which rotates the rotating shaft of the cleaning roller 54. The blade 55 is formed in a plate shape with the same width as that of the transport belt 23 in the Y axis direction, or a width which is slightly larger than that, and for example, it is possible to form the blade using silicone rubber, or the like. The blade 55 is provided on the downstream side of the cleaning roller 54 in a movement direction of the transport belt 23.

[Contact Force of Cleaning Unit]

FIG. 2 is an enlarged view of the cleaning unit. FIG. 3 is an enlarged view of the groove portion. A force which is generated in the cleaning unit in a case in which the cleaning unit is caused to come into contact with the transport belt will be described by using FIGS. 2 and 3. In addition, for ease of descriptions, the force generated in the cleaning unit is denoted by an arrow in FIGS. 2 and 3.

FIG. 2 illustrates a case in which the cleaning unit 51 is arranged at the cleaning position, and the cleaning roller 54 and the blade 55 are caused to come into contact with the surface 23*a* of the transport belt 23. When the cleaning roller 54 is caused to come into contact with the transport belt 23, a first force P1 which goes downward in the vertical direction (−Z axis direction) is generated in the cleaning unit 51. In addition, when the blade 55 is caused to come into contact with the transport belt 23, a second force P2 which goes downward in the vertical direction (−Z axis direction) is generated in the cleaning unit 51. In addition, when the belt driving roller 25 is driven, and the transport belt 23 rotates, a third force P3 (friction force) in the horizontal direction (−X axis direction) is generated in the cleaning unit 51 through the blade 55.

A force which is generated in the cleaning unit 51, and goes downward in the vertical direction due to the third force P3 will be described by using FIG. 3. As illustrated in FIG. 3, in a contact point CP of the positioning pin 72 and the groove portion 80, a reaction force P3 which is equal to the third force P3 works in the +X axis direction. As described above, the groove portion 80 forms the isosceles triangle of which the upper end is open in the V shape. When an angle formed of a vertical line 83 which is orthogonal to the base and the equal sides 81 at an apex at which the equal sides 81 and the base 82 of the isosceles triangle cross each other is set to θ, a force P3 tan θ which goes downward in the vertical direction is generated in the cleaning unit 51 (contact point CP). Accordingly, in a case in which the cleaning unit 51 is arranged at the cleaning position, and the transport belt 23 is driven, a force of P1+P2+P3 tan θ which goes downward in the vertical direction is added to the cleaning unit 51.

In other words, it is possible to prevent the cleaning unit 51, and the positioning pins 71 and 72 from being separated from each other, by setting a force (pressing) F which causes the cleaning unit 51 to come into contact with the positioning pins 71 and 72 to be larger than P1+P2+P3 tan θ. Accordingly, the cleaning unit 51 according to the embodiment is caused to come into contact with the positioning pins 71 and 72 using the force (pressing) F which forms a relationship of F>P1+P2+P3 tan θ.

Since the two positioning pins 71 and 72 which are attached to the frame unit 92 (housing) of the liquid ejecting apparatus 100, and the cleaning unit 51 come into contact with each other without being separated, it is possible to suppress a motion of the cleaning unit 51 which tries to vibrate in the vertical direction. In addition, since the groove portion 80 and the positioning pin 72 which are provided in the cleaning unit 51 are engaged with each other, it is possible to suppress a motion of the cleaning unit 51 which tries to vibrate in the horizontal direction.

In a liquid ejecting apparatus in the related art, since the positioning pins 71 and 72, and the groove portion 80 are not provided, it was necessary to suppress a motion of the cleaning unit 51 which tries to vibrate in the horizontal direction using rigidity of the cleaning device 50. In order to increase the rigidity of the cleaning device 50, it was necessary to adopt an air cylinder 56 or a ball bush 57 of which a sectional area in the horizontal direction is large in the pressing unit 52 which supports the cleaning unit 51, or increases the number thereof, and accordingly, this caused a rise in cost of the liquid ejecting apparatus. In the liquid ejecting apparatus 100 according to the embodiment, since a vibration of the cleaning unit 51 in the horizontal direction is suppressed by using the groove portion 80 and the positioning pin 72, it is possible to configure the liquid ejecting apparatus 100 including the cleaning device 50 at a low cost.

[Cleaning Method of Transport Belt]

FIG. 4 is a flowchart which describes a cleaning method of the transport belt 23. The cleaning method of the transport belt 23 will be described by using FIG. 4.

Step S1 is a preparation process. First, the cleaning device 50 is arranged at a predetermined position, and is fixed to the floor face 99 using the moving unit 53. This process is performed by a user.

Step S2 is a contact process in which the cleaning unit 51 is caused to come into contact with the positioning pins 71 and 72 using the force F which forms the relationship of $F>P1+P2+P3 \tan\theta$. The control unit 90 moves the cleaning unit 51 from the evacuation position to the cleaning position by driving the air cylinder 56 of the pressing unit 52, and causes the cleaning unit to come into contact with the positioning pins 71 and 72. At this time, the cleaning roller 54 and the blade 55 come into contact with the transport belt 23, and the cleaning unit 51 is pressed to the positioning pins 71 and 72 using the force F which forms the above described relationship of $F>P1+P2+P3 \tan\theta$.

Step S3 is a cleaning process for cleaning the transport belt 23 by rotating the transport belt 23 and the cleaning roller 54. The control unit 90 rotates the transport belt 23 by driving the belt driving roller 25. In addition, the control unit 90 drives a driving motor (not illustrated) which rotates a rotating shaft of the cleaning roller 54, and rotates the cleaning roller 54. In this manner, brushes of the cleaning roller 54 and the surface 23*a* of the transport belt 23 slide. At this time, cleaning liquid which is stored in the cleaning unit 51 is supplied to the surface (support face) 23*a* of the transport belt 23 through the brushes of the cleaning roller 54, and ink, a fiber of cloth as a recording medium, or the like, which is attached to the transport belt 23 is removed by using the brushes. Thereafter, the blade 55 and the surface 23*a* of the transport belt 23 slide along with a movement of the transport belt 23, and cleaning liquid remaining on the surface 23*a* of the transport belt 23 is removed by using the blade 55.

Step S4 is a stopping process in which the cleaning operation is stopped. The control unit 90 stops driving of the driving motors of the belt driving roller 25 and the cleaning roller 54. In addition, the control unit 90 moves the cleaning unit 51 from the cleaning position to the evacuation position by stopping driving of the air cylinder 56, and finishes the operation of cleaning the transport belt 23.

In addition, according to the embodiment, the groove portion 80 is provided at a position of being in contact with the positioning pin 72; however, the groove portion may be provided at a position of being in contact with the positioning pin 71, or may be provided at both the positions. In addition, according to the embodiment, two positioning pins 71 and 72 are provided; however, three or more positioning pins may be provided.

As described above, according to the liquid ejecting apparatus 100 in the embodiment, it is possible to obtain the following effects.

The positioning pins 71 and 72 for positioning the cleaning unit 51 at the cleaning position are provided in the frame unit 92 of the liquid ejecting apparatus 100. The groove portion 80 which is engaged with the positioning pin 71 is provided in the cleaning unit 51. The cleaning position of the cleaning unit 51 is positioned when the positioning pin 71 and the upper end of the side wall of the cleaning unit 51 come into contact with each other, and the positioning pin 72 and the groove portion 80 come into contact with each other (engaged). The cleaning unit 51 is pressed to the positioning pins 71 and 72 using a pressing force F larger than the reaction force ($P1+P2+P3 \tan\theta$) which goes downward in the vertical direction, and occurs in the cleaning unit 51 in a case in which the cleaning roller 54 and the blade 55 are caused to come into contact with the surface 23*a* of the transport belt 23. In this manner, since the cleaning unit 51 and the positioning pins 71 and 72 come into contact with each other without being separated, it is possible to suppress a vibration which occurs in the cleaning unit 51 when cleaning the transport belt 23. In the related art, it was necessary to strengthen rigidity of the cleaning device 50 so as to suppress the vibration which occurs in the cleaning unit 51, in order to improve a cleaning performance with respect to the transport belt 23. However, since the vibration which occurs in the cleaning unit 51 is suppressed by adopting the embodiment, it is possible to configure the liquid ejecting apparatus 100 at a low cost. Accordingly, it is possible to provide the liquid ejecting apparatus 100 in which a cleaning performance with respect to the transport belt 23 is improved while suppressing a rise in cost of the apparatus.

A cleaning method of the transport belt of the liquid ejecting apparatus 100 includes a contact process in which the cleaning unit 51 is caused to come into contact with the positioning pins 71 and 72, and a cleaning process in which the transport belt 23 is cleaned by rotating the transport belt 23 and the cleaning roller 54. In the contact process, the cleaning unit 51 is pressed to the positioning pins 71 and 72 using the pressing force F larger than the reaction force ($P1+P2+P3 \tan\theta$) which goes downward in the vertical direction, and occurs in the cleaning unit 51, in a case in which the cleaning roller 54 and the blade 55 are caused to come into contact with the surface 23*a* of the transport belt 23. In this manner, it is possible to suppress the vibration which occurs in the cleaning unit 51 in the cleaning process, since the cleaning unit 51 and the positioning pins 71 and 72 come into contact with each other without being separated, even in a case in which the transport belt 23 and the cleaning roller 54 are rotated in the cleaning process. In the related art, it was necessary to strengthen rigidity of the cleaning device 50 so as to suppress a vibration which occurs in the cleaning unit 51 in order to improve a cleaning performance with respect to the transport belt 23, and it caused a rise in cost of the apparatus. However, since the vibration which occurs in the cleaning unit 51 is suppressed by adopting the embodiment, it is possible to configure the liquid ejecting apparatus 100 at a low cost. Accordingly, it is possible to provide a cleaning method of the transport belt of the liquid ejecting apparatus 100 in which a cleaning performance with respect to transport belt 23 is improved while suppressing a cost rise of the apparatus.

Modification Example

FIG. 5 is a schematic view which illustrates a schematic configuration of a cleaning unit of a liquid ejecting apparatus according to a modification example. FIG. 6 is a sectional view which is taken along line VI-VI in FIG. 5. The liquid ejecting apparatus according to the modification example will be described with reference to FIGS. 5 and 6. In addition, the same constituent portions as those in the embodiment will be given the same reference numerals, and redundant descriptions will be omitted. The liquid ejecting apparatus according to the modification example is provided with a locking mechanism which fixes a cleaning unit to a cleaning position.

As illustrated in FIG. 5, groove portions 80*a* and 80*b* which are engaged with positioning pins 71 and 72 are provided in a cleaning unit 151. Since configurations of the groove portions 80*a* and 80*b* are the same as that in the above described groove portion 80, descriptions thereof will be omitted. The cleaning unit 151 is pressed to the positioning pins 71 and 72 using a pressing force F by using a pressing unit 52, and is arranged at a cleaning position when the positioning pins 71 and 72 are engaged with the groove portions 80*a* and 80*b*. In addition, the cleaning unit 151 according to the modification example is provided with a locking mechanism 110 which fixes the cleaning unit to a cleaning position in a state in which the positioning pins 71 and 72 are engaged with the groove portions 80*a* and 80*b*.

Subsequently, a configuration of the locking mechanism 110 will be described. In the following descriptions, the locking mechanism 110 which fixes the positioning pin 72 to the groove portion 80*a* will be described. The locking mechanism 110 includes a beam unit 111, two beam accommodating units 112, and an actuator 113.

The beam unit 111 is formed in a rectangular parallelepiped shape which extends in the X axis direction. The beam unit 111 is provided along the X axis direction at the upper end of a side wall 151*a* of the cleaning unit 151 in the Y axis direction. The beam unit 111 can move between a closing position at which an opening portion of the groove portion 80*a* is covered and an opening position at which the opening portion is opened. The beam unit 111 is moved along the ±X axis direction using the actuator 113. The actuator 113 can be configured of an air cylinder, a movement mechanism in which a motor and a gear are combined, or the like.

The beam accommodating unit 112 is formed in a rectangular shape in a side view in the Y axis direction, and forms a recessed shape in a side view in the X axis direction. As illustrated in the side view in the X axis direction in FIG. 6, an opening portion 112*a* of the recessed beam accommodating unit 112 is open downward (−Z axis direction) in the vertical direction. The opening portion 112*a* of the beam accommodating unit 112 involves the beam unit 111 which is provided at the upper end of the side wall 151*a* of the cleaning unit 151 along the X axis direction by covering the beam unit from the upper side (+Z axis direction), and in which an inner wall of an opening end of the opening portion 112*a* and both side faces on the upper part of the side wall 151*a* are connected. In this manner, the beam unit 111 can move in a space which is formed of a recessed inner wall of the beam accommodating unit 112 and the upper end of the side wall 151*a* in a sliding manner.

When the cleaning unit 151 is pressed to the positioning pins 71 and 72 using a force F which forms a relationship of $F>P1+P2+P3 \tan\theta$ when the transport belt 23 is in a state of rotating, or using a force F which forms a relationship of $F>P1+P2$ when the transport belt 23 is in a state of not rotating, in a state in which the beam unit 111 of the locking mechanism 110 is set to an opening position using the pressing unit 52, the groove portions 80*a* and 80*b* engage with the positioning pins 71 and 72. When the beam unit 111 of the locking mechanism 110 is moved to the opening position in this state, the beam unit 111 is fixed to the upper end of the side wall 151*a* of the cleaning unit 151 in the two beam accommodating units 112, and closed spaces in which the positioning pins 71 and 72 are surrounded with triangles which are formed of the groove portions 80*a* and 80*b* and the beam units 111 are formed. In this manner, the positioning pin 72 is fixed to the cleaning unit 151 using the groove portion 80*a* and the beam unit 111, and the positioning pin 71 is fixed to the cleaning unit 151 using the groove portion 80*b* and the beam unit 111.

Since the cleaning unit 151 is continuously held at the cleaning position even when the force F is reduced, by stopping driving of the pressing unit 52 (air cylinder 56) for causing the cleaning unit 151 to come into contact with the positioning pins 71 and 72 continuously in this state, it is possible to reduce power consumption of the liquid ejecting apparatus 100.

In addition, the locking mechanism 110 which is exemplified in the modification example is merely an example, and is not limited to this. The locking mechanism may have a configuration in which engagements of the positioning pins 71 and 72 with the groove portions 80*a* and 80*b* when the cleaning unit 151 is caused to come into contact with the positioning pins 71 and 72 are held.

REFERENCE SIGNS LIST

10 Recording medium supply unit
11 Supply shaft
12 Bearing
20 Recording medium transport unit
21, 22, 26, 28 Transport roller
23 Transport belt
24 Belt rotating roller
25 Belt driving roller
27 Drying unit
29 Adhesive layer
30 Recording medium collecting unit
31 Winding shaft
32 Bearing
40 Printing unit
41 Head moving unit
42 Ejecting head
43 Carriage
44 Ejecting face
45 Nozzle column
50 Cleaning device
51 Cleaning unit
52 Pressing unit
53 Moving unit
54 Cleaning roller
55 Blade
56 Air cylinder
57 Ball bush
60 Medium adhering unit
61 Pressing roller
62 pressing roller driving unit
63 Roller support unit
71, 72 Positioning pin
80, 80*a*, 80*b* Groove portion
81 Equal sides
82 Base
83 Vertical line
90 Control unit
92 Frame unit
95 Recording medium

100 Liquid ejecting apparatus
110 Locking mechanism
111 Beam unit
112 Beam accommodating unit
113 Actuator
151 Cleaning unit
151*a* side wall

The invention claimed is:

1. A liquid ejecting apparatus comprising:

a transport belt which transports a recording medium; and a cleaning unit which cleans the transport belt, wherein the cleaning unit can move between a cleaning position and an evacuation position, and is positioned at the cleaning position using a positioning pin which is provided in a housing, and a groove portion which is provided in the cleaning unit, and wherein the groove portion forms a V-shaped isosceles triangle along the vertical direction.

2. The liquid ejecting apparatus according to claim 1, wherein the cleaning unit includes a cleaning roller which cleans the transport belt, and a blade which removes water droplets of the transport belt, and wherein, when an angle formed of a vertical line which is orthogonal to a base and equal sides at a point at which the equal sides cross the base cross is set to θ, a force in the vertical direction which occurs in the cleaning unit when the cleaning roller comes into contact with the transport belt is set to P1, a force in the vertical direction which occurs in the cleaning unit when the blade comes into contact with the transport belt is set to P2, and a force in the horizontal direction which occurs in the cleaning unit when the blade comes into contact with the transport belt is set to P3, the cleaning unit comes into contact with the positioning pin using a force F which forms a relationship of F>P1+P2+P3 tan θ.

3. The liquid ejecting apparatus according to claim 1, further comprising:

a locking mechanism which fixes the cleaning unit to the cleaning position.

4. A cleaning method of a transport belt of a liquid ejecting apparatus which includes the transport belt which transports a recording medium, a cleaning unit which includes a cleaning roller for cleaning the transport belt, and a blade which removes water droplets of the transport belt, and a positioning pin which is provided in a housing, and in which a groove portion which forms a V-shaped isosceles triangle is provided in the cleaning unit, the method comprising:

causing the cleaning unit to come into contact with the positioning pin using a force F which forms a relationship of F>P1+P2+P3 tan θ when an angle formed of a vertical line which is orthogonal to a base and equal sides at a point at which the equal sides and the base of the groove portion cross each other is set to θ, a force in a vertical direction which occurs in the cleaning unit when the cleaning roller comes into contact with the transport belt is set to P1, a force in the vertical direction which occurs in the cleaning unit when the blade comes into contact with the transport belt is set to P2, and a force in a horizontal direction which occurs in the cleaning unit when the blade comes into contact with the transport belt is set to P3; and cleaning the transport belt by rotating the transport belt and the cleaning roller.

* * * * *